United States Patent [19]

Khaidurov et al.

[11] 3,978,762

[45] Sept. 7, 1976

[54] COMPENSATOR FOR SPORTING FIREARMS

[76] Inventors: Efim Leontievich Khaidurov, ulitsa Glagoleva 25, korpus 2, kv. 138, Moscow; Vladimir Alexandrovich Razorenov, ulitsa Ponomareva 4a, kv. 51, Minsk, both of U.S.S.R.

[22] Filed: May 16, 1974

[21] Appl. No.: 470,556

[52] U.S. Cl. ..... 89/14 C

[51] Int. Cl.[2] ..... F41C 21/18; F41F 17/12

[58] Field of Search ..... 89/14 C, 14 D, 14 R; 42/79

[56] References Cited

UNITED STATES PATENTS

| | | | |
|---|---|---|---|
| 3,455,203 | 7/1969 | Pillersdorf | 89/14 |
| 3,714,864 | 2/1973 | Thierry | 89/14 C |
| 3,808,943 | 5/1974 | Kelly | 89/14 C |
| 3,858,481 | 1/1975 | Elliott | 89/14 C |

*Primary Examiner*—Samuel W. Engle
*Assistant Examiner*—Ralph Palo
*Attorney, Agent, or Firm*—Haseltine, Lake & Waters

[57] ABSTRACT

A compensator for sporting firearms, made as a case formed by two bars which are interconnected by means of crosswise baffle plates provided with holes for a bullet to pass therethrough and having a width exceeding that of the top bar, with a cover attached to the case and embracing it over its bottom and both sides, and with powder gas outlet holes on the top of the compensator.

4 Claims, 5 Drawing Figures

COMPENSATOR FOR SPORTING FIREARMS

The present invention relates to sporting firearms, and, more particularly, to sporting firearms compensators.

The sporting firearms compensator of the present invention can most advantageously be fitted to sporting pistols.

Known in the art are sporting firearms compensators which utilize the kinetic energy of powder gases to provide for partial compensation for the jumping of firearms at shooting.

The prior art sporting firearms compensators comprise an inclined baffle plate arranged at a certain distance in front of the muzzle. A hole made in the baffle plate provides passage for a bullet, and the inclined surface of the baffle plate serves to deflect powder gases.

Also known are compensators contrived as a case fitted on the muzzle section, with a chamber to receive powder gases produced when a round is fired. A hole is made in the front wall of the chamber for a bullet to pass therethrough, and holes in the side walls and in the top plate thereof direct the discharged powder gases.

Commonly, the compensators furnished with an inclined baffle plate only do not afford sufficient compensation for the jumping of firearms due to the action of powder gases.

In other prior art compensators for sporting firearms, a heavy deposit of powder combustion products and particles of lead and unburnt powder is accumulated in the course of long service. The fouling must be removed periodically since particles separating from the deposit may collide with the bullet thereby causing it to deflect from the target.

A disadvantage inherent in the compensators resides in that they lack convenient means for the removal of fouling. In addition, the manufacture of the compensator cases is rather complicated.

The primary object of the invention is to provide a sporting firearms compensator which permits easy and complete removal of the fouling during service.

Another object of the present invention is to provide a compensator which is relatively easy to manufacture.

A further object of the invention is to provide a sporting firearms compensator wherein the energy of the powder gases is utilized most efficiently to reduce the jumping of firearms at shooting.

With these and other objects in view, a sporting firearms compensator is herein proposed, in which the energy of the powder gases is used to compensate for the jumping of the firearms at shooting and which is constructed as a case formed by top and bottom lengthwise bars spaced a certain distance apart and interconnected by means of crosswise baffle plates having a width exceeding that of the top bar, with a cover attached to the case and embracing it over its bottom and both sides, the inner side surfaces of the cover serving as the compensator deflecting surfaces. Powder gas outlet holes are formed by the cover inner side surfaces, the top bar and the crosswise baffle plates being provided on the top of the compensator.

It is expedient that the cover inner side surfaces be mutually arranged so as to form a V-shaped cross-section with a view to reduce the firearms jumping at shooting through partial utilization of the force produced by the expanding powder gases.

It is also advisable that the cover be linked with the case by means of a spring-loaded latch installed in the cover and furnished with a tooth which engages the case by entering a recess provided therein. The above connection of the case to the cover permits easy disassembly and assembly thereof during service.

It is also suggested that the latch tooth has a bevel sliding over a mating bevel in the recess to allow easy separation of the cover when it sticks to the case after prolonged shooting.

The sporting firearms compensator constructed according to the present invention permits easy cleaning in service. Another advantage of the compensator is simple construction and easy manufacture thereof.

Other objects and advantages of the present invention will hereinafter become more fully apparent from the following description taken in conjunction with the accompanying drawings, wherein.

Figure 1:
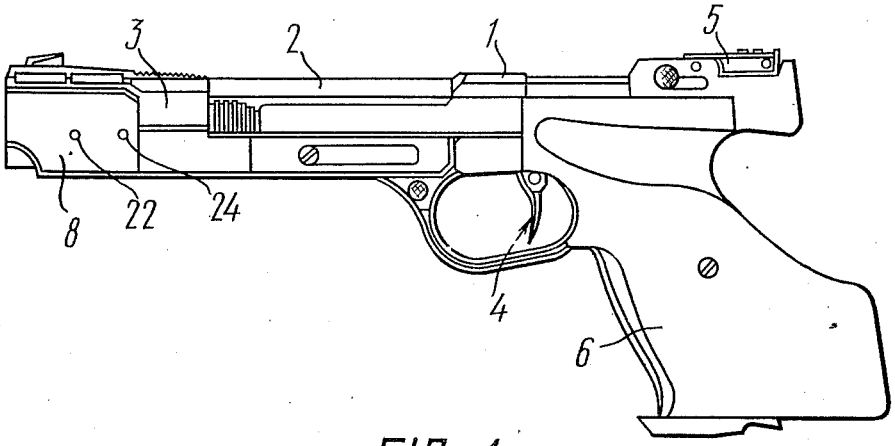
FIG. 1 is a general view of a sporting pistol with a compensator according to the invention.

Referring now to FIG. 1, the sporting pistol comprises a frame 1 which receives a barrel 2 with a compensator 3 installed on the muzzle section of the barrel 2, a trigger mechanism 4, a sight 5 and a grip 6.

Figure 2:
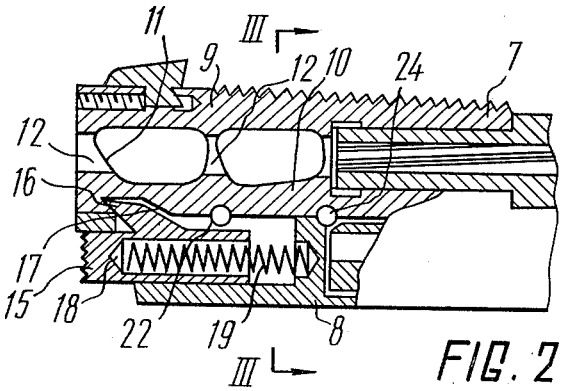
FIG. 2 is a longitudinal vertical-section view of the compensator taken along line II—II of FIG. 3.

The compensator 3 comprises a case 7 (FIG. 2) and a cover 8 attached thereto. The case 7 is composed of a top bar 9 and a bottom bar 10 interconnected by means of crosswise baffle plates 11 with holes 12 for the passage of a bullet. The baffle plates 11 arranged across the bars 9 and 10 are spaced apart and tilted forward.

Figure 3:
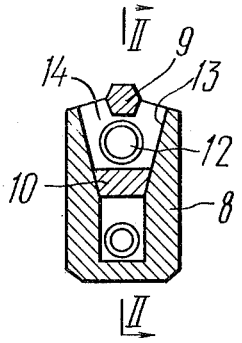
FIG. 3 is a sectional view of the compensator taken along line III—III of FIG. 2.

The bar 10 is somewhat wider than the bar 9, and the section of each baffle plate 11 is shaped as a trapezoid with the base turned toward the top bar 9 as shown in FIG. 3. Thus, the case 7 is open on the top and on both sides.

In order that an internal space be formed inside the case 7, the cover 8 embraces the case over its bottom and sides.

Side surfaces 13 of the cover 8, which are adjacent to the side surfaces of the buffle plates 11, serve as the side deflecting surfaces of the compensator 3.

Holes 14 provided between the side surfaces 13 of the cover 8, outer bar 9 and baffle plates 11 are located on the top of the compensator 3 and are used to discharge the powder gases.

The inner side surfaces 13 of the cover 8 are mutually inclined so as to form a V-shaped cross-section with a view to partially utilize the force produced in firing by the expanding powder gases and, thereby, to minimize the jumping of the pistol at shooting.

The powder gases trapped inside the case 7 expand and exert a pressure on the side surfaces 13 of the cover 8. The pressure applied to the side surfaces is resolved into horizontal components acting in opposite directions, and into vertical components directed downward. The horizontal components balance each other whereas the vertical components added together counteract the force which tends to move the pistol upward.

Figure 4:
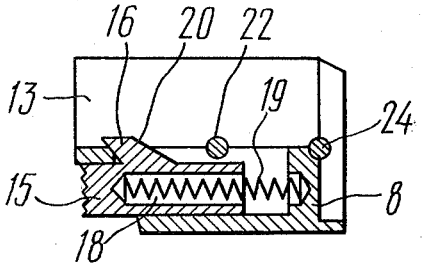
FIG. 4 is a longitudinal sectional view of the compensator cover and latch.
Figure 5:
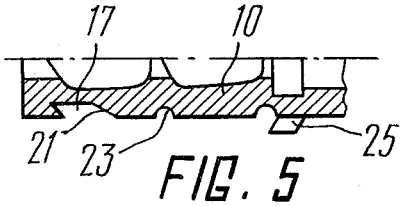
FIG. 5 is a longitudinal section view of the compensator case bottom bar.

The cover 8 is attached to the case 7 by means of a latch 15 located in the bottom portion of the cover 8. A tooth 16 (FIGS. 2 and 4) provided in the latch 15 enters a recess 17 in the bottom bar of the case 7. The latch 15 is loaded axially by a spring 19 accommodated in a hole 18 and pushing against the cover 8. Thus, the latch 15 is pressed permanently in the axial direction against the case 7.

When the cover is being opened, a bevel 20 (FIG. 4) provided on the tooth 16 of the latch 15 on the side opposite to that adjacent to the case 7 slides over a respective bevel 21 in the bottom bar 10 of the case 7. This tooth arrangement permits easy separation of the cover 8 when it sticks to the case 7 after shooting.

To prevent longitudinal displacements of the cover 8 relative to the case 7, the cover is held by a pin 22 introduced into a respective groove 23 in the bottom bar 10 of the case 7. In addition, the joint of the cover 8 is locked by a pin 24 which engages a boss 25 in the case 7.

The sporting firearms compensator operates as follows. When a round is fired, a part of the powder gases discharged from the bore encounters the crosswise baffle plates 11 of the case 7 and the side deflecting surfaces 13 of the cover 8. The powder gases acting on the crosswise baffle plates 11 flow in an upward direction. Inasmuch as the baffle plates are inclined forward, the force exerted by the gases is directed forward and downward, and compensates for the kickback tending to jerk the pistol backward and upward.

The powder gases expanding inside the case 7 act upon the side surfaces 13 of the cover 8. The force applied to the inclined side surfaces is resolved into horizontal components directed oppositely, and into vertical components directed downward. The horizontal components balance each other whereas the vertical components added together counter-act the force that moves the pistol upward.

If cleaning of the compensator 3 is required, the cover 8 has to be separated from the case 7. With the latch 115 pushed down, the spring 19 is compressed, the tooth bevel 20 slides over the case bevel 21 and the tooth 16 is detached from the case. The pin 22 leaves the groove 23 provided in the case 7. Now the cover 8 is easily separated from the case 7.

The above structure permits easy detachment of the cover 8 even if the cover sticks to the case 7 by virtue of powder fouling accumulated during service. With the cover removed, the dirty surfaces of the case are readily accessible for cleaning.

What is claimed is:

1. A compensator for sporting firearms, which utilizes the energy of the powder gases to reduce the jumping of the firearms at shooting, comprising: a case having top and bottom bars spaced a certain distance apart, said bottom bar being somewhat wider than said top bar, said case being open on its top and both sides; crosswise baffle plates to link said bars, being tilted in the forward direction with respect to the longitudinal axis of the compensator so that when a shot is fired the gases are deflected upward, said baffle plates being trapezoidal in shape with the base upwards, and provided with holes for a bullet to pass therethrough, and also having a width exceeding that of said top bar; a cover attached to said case and embracing it over its bottom and both sides, the inner side surfaces of said cover serving as side deflecting surfaces of the compensator; gas outlet holes on the top of the compensator, formed by said inner side surfaces, said top bar and said baffle plates; and wherein said case, said cover and said deflecting surfaces constitute means for resolving the pressure of the gases applied to said deflecting surfaces into horizontal and vertical components, the former acting in opposite directions and balancing out each other, whereas the latter are directed downward, are added together, and counteract the force that would tend to move upward the firearms.

2. A compensator for sporting firearms, which utilizes the energy of the powder gases to reduce the jumping of the firearms at shooting, comprising: a case having top and bottom bars spaced a certain distance apart; crosswise baffle plates to link said bars, provided with holes for a bullet to pass therethrough and having a width exceeding that of said top bar; a cover attached to said case and embracing it over its bottom and both sides, the inner side surfaces of said cover serving as side deflecting surfaces of the compensator; and gas outlet holes on the top of the compensator, formed by said inner side surfaces, said top bar and said baffle plates; wherein said inner side surfaces are arranged so as to form together a V-shaped cross-section, to reduce the jumping of the firearms.

3. A compensator for sporting firearms, which utilizes the energy of the powder gases to reduce the jumping of the firearms at shooting, comprising: a case having top and bottom bars spaced a certain distance apart; crosswise baffle plates to link said bars, provided with holes for a bullet to pass therethrough and having a width exceeding that of said top bar; a cover attached to said case and embracing it over its bottom and both sides, the inner side surfaces of said cover serving as side deflecting surfaces of the compensator; and gas outlet holes on the top of the compensator, formed by said inner side surfaces, said top bar and said baffle plates; wherein said cover is linked with said case through a spring-loaded latch fitted into the former and provided with a tooth which can enter a recess in the latter, to facilitate disassembly.

4. The compensator as defined in claim 3, wherein said latch tooth has a bevel that can slide over a mating bevel in said recess during opening of said cover, to allow easy seaparation of the latter when stuck to said case after prolonged shooting.

* * * * *